United States Patent [19]

Kozima

[11] 4,184,355

[45] Jan. 22, 1980

[54] METHOD AND A PUNCH/DIE ASSEMBLY FOR THE PRODUCTION OF HEAT EXCHANGER FINS

[75] Inventor: Toyoo Kozima, Ohmorihigashi, Japan

[73] Assignee: Hidaka Engineering Co., Ltd., Tokyo, Japan

[21] Appl. No.: 887,421

[22] Filed: Mar. 16, 1978

Related U.S. Application Data

[60] Division of Ser. No. 777,326, Mar. 14, 1977, Pat. No. 4,109,501, which is a continuation-in-part of Ser. No. 604,306, Aug. 13, 1975, Pat. No. 4,055,067.

[30] Foreign Application Priority Data

Sep. 11, 1974 [JP] Japan ..... 49/103808

[51] Int. Cl.[2] ..... B21D 31/02

[52] U.S. Cl. ..... 72/327; 72/349; 72/370

[58] Field of Search ..... 72/327, 329, 333, 335, 72/337, 379, 349, 370

[56] References Cited

U.S. PATENT DOCUMENTS

| | | | |
|---|---|---|---|
| 1,688,111 | 10/1928 | Böhle | 72/379 X |
| 1,724,486 | 8/1929 | Karmazi | 72/327 |

*Primary Examiner*—Leon Gilden

[57] ABSTRACT

A method of producing heat exchanger fins, comprising the steps of perforating an aperture of a small diameter in a predetermined portion of a sheet material, while simultaneously forming a projecting cylinder of a diameter smaller than that of the flanged aperture to be ultimately formed, and machining the projecting cylinder into a flange of a predetermined dimension by simultaneous burring an ironing operations using a punch of a predetermined size.

4 Claims, 8 Drawing Figures

METHOD AND A PUNCH/DIE ASSEMBLY FOR THE PRODUCTION OF HEAT EXCHANGER FINS

CROSS-REFERENCES TO RELATED APPLICATION

This is a division of application Ser. No. 777,326 filed Mar. 14, 1977 now U.S. Pat. No. 4,109,501, which is a continuation-in-part application of the present applicant's copending application Ser. No. 604,306, filed Aug. 13, 1975 now U.S. Pat. No. 4,055,067.

BACKGROUND OF THE INVENTION

This invention relates to a method and a punch/die assembly for use in the production of heat exchanger fins as in, for example, air conditioners for rooms and motor vehicles, and, in particular, to a method which does not require any preliminary punching prior to the regular punching indispensable to the conventional manufacturing process of said fins, which contributes to remarkable improvement of productive efficiency and quality of products.

In general, the cooling fins are constituted by a number of superposed square sheets each having a multiple number of flanged apertures in registration with similar flanged apertures in the overlying and underlying sheets, and a number of copper tubes passed through the respective flanged apertures. The flanges are usually turned outwardly to form flares around the marginal edges of the apertures for the purpose of maintaining a predetermined distance between the adjacent apertures and at the same time for reinforcing purposes. Therefore, the flanges are required to have projecting height of at least of, for example, more than 1.8 mm.

In forming a flanged aperture in an aluminum sheet, it has been the conventional practice to perforate or pierce in the first step an aperture which has a diameter far smaller than that of a flanged aperture to be ultimately formed, and then pressing or burring the marginal edge portions upwardly by means of a punch thereby to form the flanged aperture of the predetermined dimension. However, where the aperture is decreased in diameter in an attempt to increase the height of the ultimate flange, cracking often occurs to the marginal edge portions of the aperture when pressed by the punch. Therefore, without a preliminary treatment or machining, it has been difficult to form a flange which has a height greater than 1.8 mm.

The pre-machining usually includes pressing of an aluminum sheet by a punch to form a bonnet-like recess of a diameter far larger than that of the intended flanged aperture and further pressing of the recessed portion by another punch to reduce its diameter while increasing its height. These operations are repeated and then the aforementioned steps are employed to obtain a number of flanged apertures of the predetermined diameter and height. This method is generally referred to as "drawing" and is capable of forming a flange of a relatively great height by the gradual or progressive stretching of the aluminum sheet. However, the just-mentioned method has inherent drawbacks in that the circumferential wall of the flanged aperture bears concentric hammered marks as a result of the repeated punching operation and wrinkles appear at the both sides of the aluminum sheet to cause warping or distortion to the fins as a whole.

SUMMARY OF THE INVENTION

It is an object of the present invention to provide a method and a punch/die assembly for use in the production of heat exchanging fins with high efficiency.

It is another object of the present invention to provide a method and a punch/die assembly capable of producing heat exchanging fins of excellent quality.

It is a further object of the invention to provide a method and a punch/die assembly for producing heat exchanger fins which have a number of flanged apertures the height of which is greater than that of the prior art.

In one preferred form of the invention, the method of producing heat exchanger fins comprises the first step of perforating a small aperture at a predetermined position of an aluminum sheet, without the afore-mentioned pretreatment, while simultaneously forming a projecting cylinder of a diameter smaller than that of the flanged aperture to be ultimately formed, and the second step of burring and ironing the projecting cylinder into a predetermined dimension with use of a punch of a predetermined size.

DETAILED DESCRIPTION OF THE INVENTION

The method of producing heat exchanger fins according to the invention will now be described more particularly by way of a preferred embodiment shown in FIGS. 1 to 6.

Figure 1:
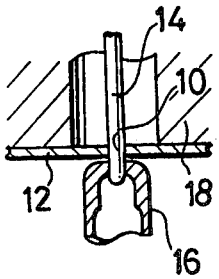
FIGS. 1 to 6 are diagrammatic sectional views illustrating the method of forming a flanged aperture according to the invention.
Figure 2:
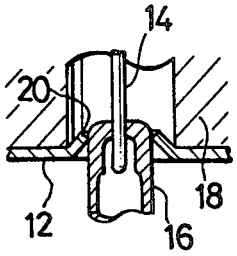
Figure 3:
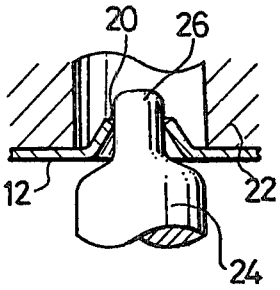
Figure 4:
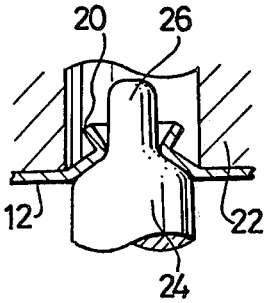
Figure 5:
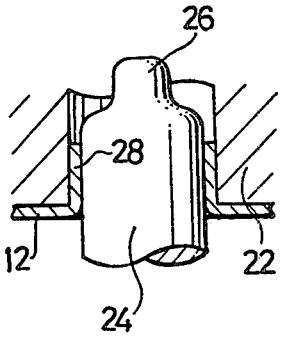
Figure 6:
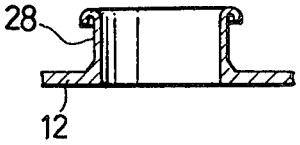

Referring to FIG. 1, a small aperture 10 for example of 6.7 mm in a diameter is perforated in an aluminum sheet 12 of for example 0.115 mm by means of a punch 14. As a punch 16 is urged into a die 18 as shown in FIG. 2, a cylinder-like projection 20 is formed around the small aperture 10 in the aluminum sheet 12 which is held against the lower surface of the die 18. The die 18 is preferably defined to have such a diameter that the cylinder-like projection 20 may be formed into a truncated cone. The upper diameter of the truncated cone 20 is for example 8.0 mm and the height is from 1.0 mm to 1.2 mm. The aluminum sheet 12 is then placed between another die 22 and a punch 24 which is designed to have a size conforming with the die 22, as shown in FIG. 3. The punch 24 has a reduced portion 26 at its upper end. The diameter of the reduced portion 26 is substantially equal to the diameter of the punch 16. As the punch 24 is urged into the die 22 as shown FIG. 4, the cylinder-like projection 20 is simultaneously burred and ironed into a flange 28 of a predetermined height for example of 2.4 mm to 2.6 mm, as shown in FIG. 5. This simultaneous burring and ironing process may be preferably divided into two steps. The first burring and ironing step makes the cylinder-like projection 20 to a shorter flange of for example 9.40 mm in an inner diameter and 1.7 mm to 2.0 mm in a height. The wall of the flange is reduced to about 70% of the original aluminum sheet thickness. The second ironing process makes the shorter flange to the predetermined flanged aperture 28 having 9.83 mm in an inner diameter and 2.4 mm to 2.6 mm in a height. The wall of the resultant flange is reduced to about 45% of the original aluminum sheet thickness. The edge of the flange 28 is then flared to define a resultant height of for example 1.8 mm to 2.2 mm and to reinforce the flange 28, as shown in FIG. 6. The dimensions stated above vary from a product to product to be manufactured.

According to the method of the invention, the cylinder-like projection 20 is formed in the first step at a desired position on the aluminum sheet 12, and, in the second step, the cylinder-like projection 20 is further pressed out by a punch 24. In this instance, the upper circumferential portions of the projecting cylinder 20 is deformed by the punch 23 with a reduced tension stress, so that a perpendicular flange 28, which has a height as long as 2.8 mm in a particular embodiment, may be formed with high efficiency and at the same time without causing cracking or other troubles.

Figure 7:
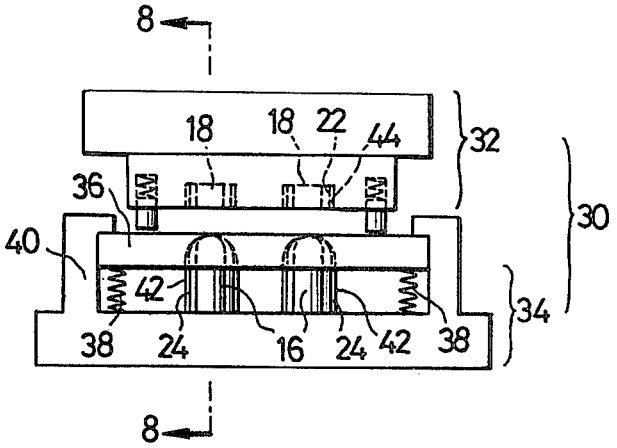
FIG. 7 is a diagrammatic front elevation of the punch and die assembly.
Figure 8:
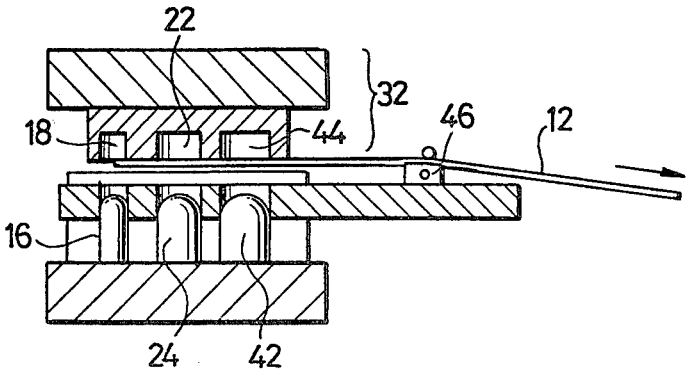
FIG. 8 is a diagrammatic side section of the same punch and die assembly.

According to the present invention, the afore-mentioned first and second steps are carried out with use of a punch/die assembly as shown in FIGS. 7 and 8. The punch and die assembly 30 comprises an upper tool holder 32 and a lower tool holder 34 having integrally therewith a stripper plate 36 which is constantly urged upwardly by springs 38 within a guide frame 40. The upper and lower tool holders 32 and 34 of the punch and die assembly 30 are mounted on a suitable press machine such that the upper tool holder 32 is pressed downwardly against spring action to effect the aforementioned first and second punching operations. More particularly, the upper tool holder 32 mounts thereon the die 18 for the first punching operation and the die 22 for the second punching operation, the dies 18 and 22 being aligned in the direction of advancement of the workpiece 10, i.e., from left to right as seen in FIG. 8. The dies 18 and 22 and the punches 19 and 23 are preferably provided in a plural number and arrayed respectively in the lateral direction (in the direction perpendicular to the workpiece feeding direction) to form simultaneously a plural number of laterally aligned flanged apertures 28 in relation with the intermittent movement of the workpiece 12. Where the simultaneous burring and ironing process is divided into two steps, a set of third punches 42 and dies 44 are provided on the lower and the upper tool holders 34 and 32, respectively. The diameter of the first punch 16 is for example 7.82 mm and the diameter of the first die 18 is for example 9.28 mm. The diameter of the second punch 24 is for example 9.83 mm and the diameter of the second die 22 is for example 9.93 mm. The diameter of the third punch 42 is for example 9.40 mm and the diameter of the third die 44 is for example 9.55 mm. The coiled aluminum sheet of workpiece 12 undergoes the first and second punching operations as it is moved intermittently or incrementally by means of a hitch-feeding mechanism 46 which is provided separately from the punch and die assembly 30. The hitch-feeding mechanism 46 for the aluminum sheet is driven in timed relation with the reciprocating movement of the upper tool holder 32.

It will be understood from the foregoing description that the present invention can completely dispense with the aforementioned pretreatments. This means that there is no need for mounting additional punches and dies on the upper and lower tool holders 32 and 34 of the assembly for the pre-machining. The stripper plate 36 which is moved up and down against the spring action is free from impacts and contributes to reduce the operation noises which would otherwise result from its reciprocating movements.

In the above-described embodiment, the punches 16 are mounted on the fixed lower tool holder 34 the dies 18 on the movable upper tool holder 32. However, needlss to say, it is also possible to mount the dies 18 on the lower holder 34 and the punch 16 on the upper holder 32.

What is claimed is:

1. A punch and die assembly for use in the formation of flanged apertures in heat-exchange fins made from a sheet metal workpiece, said assembly comprising:

a lower tool holder supporting on the upper surface thereof a plurality of sets of first and second punches with said punches in said set being at a predetermined distance from each other, an upper tool holder mounting on the lower surface thereof a plurality of sets of first and second dies in conformity with said first and second punches, respectively, one of said tool holders being movable towards and away from said other tool holder, said first dies and said first punches having a diameter smaller than the diameter of said second dies and said second punches, said first dies and said first punches being adapted to perforate a plurality of small apertures at predetermined positions on a single workpieces, and means for moving the workpiece first past said first dies and said first punches and then past said second dies and said second punches.

2. A punch and die assembly as claimed in claim 1 wherein said first dies have a diameter larger than the diameter of said first punches but smaller than the diameter of said second punches so that when said first punches are urged into said first dies, a plurality of cylinder-like projections may be formed around said small perforations.

3. A punch and die assembly as claimed in claim 1 wherein said lower tool holder further supports on the upper surface thereof a plurality of third punches at a predetermined distance from said second punches, and said upper tool holder mounting on the lower surface thereof a plurality of third dies at a predetermined distance from said second dies and in conformity with said third punches, said second punches and dies having a diameter larger than the diameter of said first punches and said first dies but smaller than the diameter of said third punches and third dies.

4. A punch and die assembly as claimed in claim 1 wherein said second punches have a reduced portion the diameter of which is substantially equal to the diameter of said first punches.

* * * * *